United States Patent [19]

Oretsky et al.

[11] Patent Number: 4,647,049

[45] Date of Patent: Mar. 3, 1987

[54] METHOD FOR PLAYING AN ALIGNMENT GAME UTILIZING A MOVEABLE GRID

[76] Inventors: Philip H. Oretsky, 4418 Northcote; Jack Fogelman, 4313 Elder, both of East Chicago, Ind. 46312

[21] Appl. No.: 565,149

[22] Filed: Dec. 23, 1983

[51] Int. Cl.[4] ..... A63F 3/00

[52] U.S. Cl. ..... 273/264; 273/282 B

[58] Field of Search ..... 273/271, 242, 236, 258, 273/272, 282, 264, 269

[56] References Cited

U.S. PATENT DOCUMENTS

| | | | |
|---|---|---|---|
| 429,250 | 6/1890 | Sperl et al. | 273/282 X |
| 2,398,726 | 4/1946 | Seguin | 273/282 X |
| 2,819,904 | 1/1958 | Nelson et al. | 273/239 |
| 3,393,914 | 7/1968 | Hill | 273/272 |
| 3,659,851 | 5/1972 | Lang et al. | 273/271 |
| 3,799,547 | 3/1974 | Hills | 273/260 |
| 3,860,242 | 1/1975 | Martin | 273/275 X |
| 3,905,601 | 9/1975 | Tindall | 273/258 |
| 4,102,535 | 7/1978 | Kindred | 273/282 |
| 4,156,528 | 5/1979 | Slade | 273/282 |
| 4,193,602 | 3/1980 | Eliot et al. | 273/236 |
| 4,385,763 | 5/1983 | Moscovich | 273/86 R |

FOREIGN PATENT DOCUMENTS

| | | | |
|---|---|---|---|
| 465979 | 5/1937 | United Kingdom | 273/272 |
| 1067562 | 5/1967 | United Kingdom | 273/272 |

OTHER PUBLICATIONS

"Quip Qubes TM ", *Playthings Magazine,* May 5, 1981, p. 86.

*Primary Examiner*—Richard C. Pinkham
*Assistant Examiner*—Matthew L. Schneider

[57] ABSTRACT

A board game including a board having a plurality of squares indicating playing piece movement areas. The game also includes a movable grid which fits over and encompasses nine of the squares on the board. Certain of the squares on the board are differently colored so as to represent bonus squares. Players move the moveable grid and their own playing pieces in an attempt to align their playing pieces in horizontal, vertical or diagonal rows. The first player reaching a predetermined score is the winner.

1 Claim, 3 Drawing Figures

METHOD FOR PLAYING AN ALIGNMENT GAME UTILIZING A MOVEABLE GRID

OBJECTS AND SUMMARY OF THE INVENTION

This invention is a game requiring the use of strategy and logic by each player. It is played upon a board consisting of rows and files of individual squares. The individual squares are adjacent, one to another, and the number of individual squares in each row and file shall normally be the same. The purpose of the game is recreational. In one embodiment of the game the playing board shall consist of one hundred individual squares, with ten squares to each row and file. Also, the centermost rows of six squares each, and the centermost files of six squares each are encompassed by a border having a distinctive color. Further, the centermost rows of eight squares each and the centermost files of eight squares each are also encompassed by a border of a second distinctive color. In addition to the playing board, the game is played with a movable grid which will correspond in size to nine of the individual squares in rows and files of three adjacent squares each. Each player is assigned a plurality of playing pieces of a distinctive color.

To facilitate the movement of the playing pieces and of the movable grid in the course of playing the game at times when the playing board cannot be placed on a flat, horizontal base, or when the playing board is subject to vibration or jarring, the board may be made of a sufficient thickness and material holes are placed at the center of each individual square to receive the bottom portion of the playing piece, and grooves are cut into the playing board along the borders which divide the individual squares, one from another, of a sufficient depth and width to receive the bottom portion of the movable grid. The upper portion of the movable grid will remain above the top plane of the playing board so as to permit its easy movement by the players. The upper portion of the playing pieces, when placed within the holes at the center of the individual squares, and encompassed by the movable grid, will project above the top plane of the movable grid for a height sufficient to permit their easy movement. As an alternate to the groove and hole embodiment of the game, the component parts of the game may consist of a playing board made of ferrous material with playing pieces and a movable grid whose bottom parts or edges are affixed to magnets.

To facilitate the identification of the playing pieces by the visually handicapped, the top of each of the four playing pieces assigned to a particular player will bear a marking or identification which will permit their easy identification by touch permitting a visually handicapped player to distinguish the playing pieces of one player from those of another.

An additional feature which may be added to the game is to color code some of the individual squares of the playing board, and to assign bonus points to those squares. In the preferred embodiment of the game the four centermost squares shall be color coded in a distinctive color, and additional squares located near the corners of the playing board shall also be color coded, but in a second distinctive color.

It is an object of one embodiment of the game for each player to arrange a plurality of his playing pieces into a row-either horizontal, vertical or diagonal-on the playing board, and within the movable grid, while at the same time moving his pieces or the movable grid in such a manner as to prevent his opponent player(s) from arranging their playing pieces into scoring rows. Points are scored when, in the preferred embodiment, three playing pieces are arranged in a scoring row, depending on the particular individual squares which the scoring pieces occupy. For example, pieces which occupy color coded squares may score bonus points. Ordinarily, the first player to reach a preselected score wins. The game can be played with a time limit, either per move or per game.

To begin the game the first player to move places the movable grid on any position on the playing board, so long as the grid encompasses nine of the individual squares. At all times during the game the grid must encompass nine of the individual squares. As part of his initial move, the first player also places one of his playing pieces upon one of the individual squares. The second player then places one of his pieces upon an individual square which is not occupied by a playing piece. Each player places one of his pieces upon the board, per turn, until all playing pieces are deployed. A player may then elect to employ his turn to either redeploy one of his playing pieces to a new position on the board, or to move the movable grid. The movable grid can be moved, in the preferred embodiment, only a distance of one square, per move, either vertically horizontally, or diagonally. The movable grid cannot be returned to the position it occupied on the immediately preceeding move.

A scoring row will occur when a player succeeds in placing three of his pieces in a row, either vertical, horizontal, or diagonal, within the movable grid. In the preferred embodiment of the game a player will score one point for each playing piece which is part of a scoring row and occupies a noncolor coded square. Two points are scored for each playing piece in a scoring row which occupies a color coded square at the center of the playing board, and three points are scored for each playing piece in a scoring row which occupies a color coded square in the corner of the playing board.

An alignment of three playing pieces in a scoring row will score points only once. Once a scoring row is formed, the three scoring pieces are removed from play, and can be returned to play at a rate of one per move. However, a player with pieces out of play may elect to employ his move to reposition the movable grid rather than to redeploy a playing piece.

If a palyer moves the movable grid in such a manner so that the grid covers a scoring row of his opponent's playing pieces, the points scored will be counted for the opponent to whom the playing pieces belong. The scoring row will not count as a move for the opponent, but the opponent's pieces will be removed from play just as if the opponent had formed the scoring row on his own move.

In the preferred embodiment of the playing board, a game played by beginning players will be contained within the centermost six rows and files of individual squares. A game played by intermediate players will be contained within the innermost eight rows and files of individual squares. A game played by advance players or by three or more players will be played upon the entire playing board of ten ranks and ten files of individual squares.

BRIEF DESCRIPTION OF THE DRAWINGS

The invention will be further described with reference to the accompanying drawings which show a preferred embodiment of the component parts of the game.

DESCRIPTION OF THE PREFERRED EMBODIMENT

Figure 3:
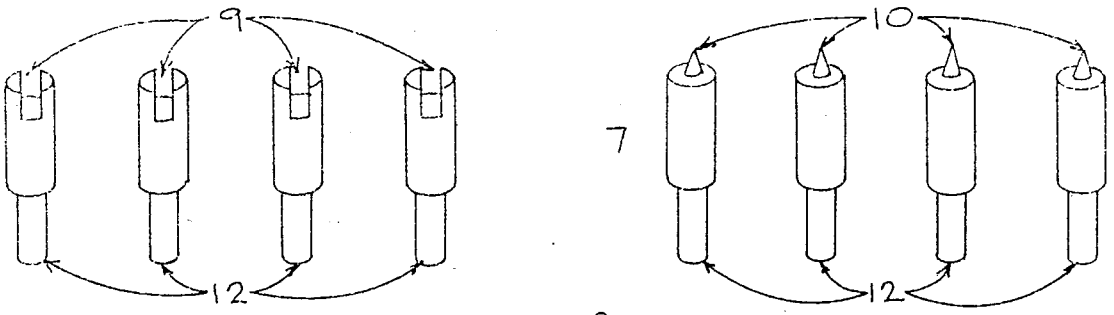
FIG. 3 is a perspective view of the playing pieces.
Figure 2:
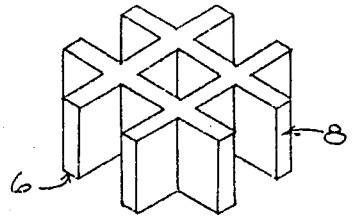
FIG. 2 is a perspective view of the movable grid.
Figure 1:
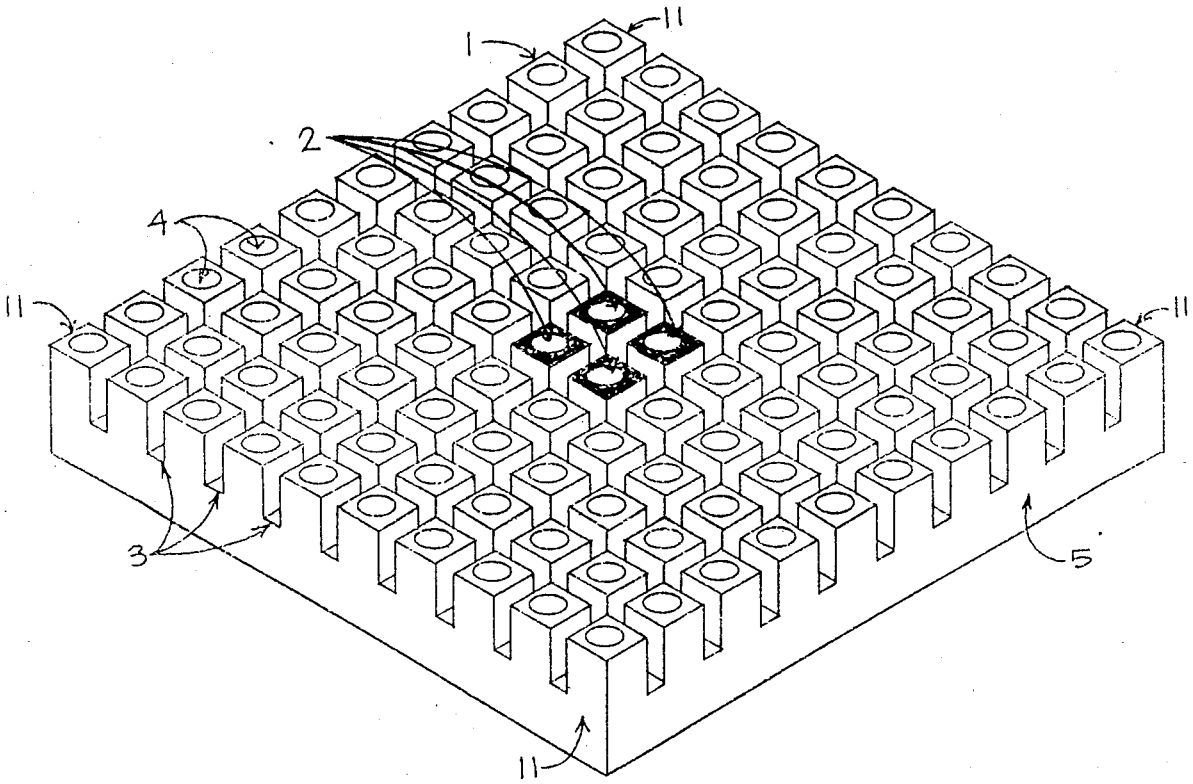
FIG. 1 is a perspective view of the preferred embodiment of the playing board.

Referring now to the drawings, the game board (5) consists of individual squares (1); the four outermost squares of the playing board, one in each corner (11), are color coded in a first color. The four centermost squares (2) of the playing board are color coded in a second color. Between each row and each file of the playing board in a groove (3) of a sufficient width and depth to allow the bottom edges of the movable grid (6) to fit within the grooves. In the center of each individual square of the playing board is a recess. (4) of a sufficient depth and diameter to permit the bottom portion of the playing pieces (12) to fit within the recess.

The movable grid has vertical walls (8) which serve to enclose nine of the individual squares of the playing board. The bottom edges of the movable grid (6) shall be of a width that will permit them to fit easily within the recessed grooves of the playing board.

The playing pieces are color coded on the top portion of each piece (7), and the bottom portion of the playing pieces taper in such a manner (12) as to permit easy insertion into the recesses (4) in the center of each individual square of the playing board.

The top portion of each respective set of the playing pieces shall bear either an indentation (9) or a protrusion (10) sufficient to permit the visually handicapped to differentiate between the playing pieces of each respective player.

What is claimed as new and desired to be secured by Letters Patent of the United States is:

1. The method of playing a game utilizing a game board apparatus comprising a substantially rectangular playing board, said board having a substantially flat playing surface, said surface being divided into a plurality of individual squares of substantially equal dimensions, a plurality of said squares being color coded in order to signify the allocation of bonus points during play, a plurality of movable pieces separated into distinguishable sets of playing pieces, each set being associated with an individual player and capable of being moved from square to square, and a single movable, substantially rectangular grid resting on the playing board defining a plurality of contiguous squares, said movable grid not being associated with any particular player but which may be moved by any player(s) of the game during the course of their turn of play, and which is capable of encompassing some or all of the movable pieces while permitting the playing pieces to be moved to other positions of the playing board without disturbing the position of the movable grid and also being capable of being moved without disturbing the positions of the playing pieces, wherein the method of play comprises the steps of: a first player, as his first turn, placing said movable grid on the playing board at any position of his choice such that the movable grid always encompasses nine of the individual squares of the playing board; said first player, also as part of his first turn, placing one of his playing pieces on one of the individual squares of the playing board; the other player(s) then placing one of their pieces upon one of the individual squares of the playing board, in turn, which is not occupied by any other piece; each player alternating turns and placing one of their playing pieces on one of the unoccupied individual squares of the playing board until all of the players' playing pieces have been placed on the playing board;

said players continuing to alternate turns with each player using their turn to either reposition the movable grid or reposition one of their own playing pieces;

said players repositioning said movable grid by moving it one square per turn either horizontally, vertically, or diagonally such that after repositioning said movable grid it continues to encompass nine of the individual squares of the playing board;

said players repositioning said movable grid and said playing pieces in an attempt to align three of said playing pieces in a row within said movable grid in either a horizontal, vertical or diagonal direction, said players gaining one point for each of their playing pieces in an aligned row on a non-color coded square and said players gaining points for the other player when repositioning of the movable grid results in the alignment of the other player's playing pieces within the movable grid, with additional points being awarded whenever playing pieces in an aligned row within the movable grid are located on color coded squares;

said players removing the playing pieces from the playing board that form an aligned row within the movable grid and then returning the removed pieces to the playing board at the rate of one per turn unless the player chooses to use his turn to reposition the movable grid;

said players being unable to reposition said movable grid to the position it occupied in the immediately preceding move;

said players continuing to reposition the movable grid, replace the removed pieces, and reposition the playing pieces until one player forms a sufficient number of scoring rows to reach a preselected score.

* * * * *